US010751864B2

(12) United States Patent
Ou

(10) Patent No.: US 10,751,864 B2
(45) Date of Patent: Aug. 25, 2020

(54) SWITCHING DEVICE FOR A NAIL GUN

(71) Applicant: PANREX INDUSTRIAL CO., LTD., Taichung (TW)

(72) Inventor: Chen-Ho Ou, Taichung (TW)

(73) Assignee: PANREX INDUSTRIAL CO., LTD., Taichung (TW)

( * ) Notice: Subject to any disclaimer, the term of this patent is extended or adjusted under 35 U.S.C. 154(b) by 119 days.

(21) Appl. No.: 16/240,199

(22) Filed: Jan. 4, 2019

(65) Prior Publication Data

US 2019/0210204 A1 Jul. 11, 2019

(30) Foreign Application Priority Data

Jan. 11, 2018 (TW) ..... 107200499 U

(51) Int. Cl.
*B25C 1/04* (2006.01)
*B25C 1/00* (2006.01)
*B25C 5/13* (2006.01)

(52) U.S. Cl.
CPC ..... *B25C 1/047* (2013.01); *B25C 1/008* (2013.01); *B25C 1/04* (2013.01); *B25C 1/043* (2013.01); *B25C 5/13* (2013.01)

(58) Field of Classification Search
CPC .. B25C 1/00; B25C 1/04; B25C 1/043; B25C 1/047; B25C 1/008; B25C 1/08; B25C 5/13
USPC ..... 227/8, 120, 130, 136, 142
See application file for complete search history.

(56) References Cited

U.S. PATENT DOCUMENTS 4,378,084 A * 3/1983 Scala ..... B25C 1/043 227/8
5,692,663 A * 12/1997 Yang ..... B25C 1/047 227/8
5,785,227 A * 7/1998 Akiba ..... B25C 1/047 227/142
6,357,647 B1 * 3/2002 Ou ..... B25C 1/008 227/10
6,450,387 B1 * 9/2002 Chen ..... B25C 1/008 227/130
6,662,989 B1 * 12/2003 Chang ..... B25C 1/008 227/130
6,929,165 B1 * 8/2005 Chen ..... B25C 1/008 227/142
2005/0045688 A1 * 3/2005 Chen ..... B25C 1/008 227/8
2006/0255085 A1 * 11/2006 Wen ..... B25C 1/008 227/8

(Continued)

*Primary Examiner* — Scott A Smith
(74) *Attorney, Agent, or Firm* — MLO, a professional corp.

(57) ABSTRACT

A switching device for a nail gun includes a trigger, a rod, a resilient member and an actuating member. The trigger includes a pair of slots each including first and second ends. Each of the first and second ends includes a small diameter portion, a large diameter portion and a shoulder portion disposed therebetween. The rod extends through the slots and includes a sliding portion and a positioning end having a diameter larger than that of the sliding portion. The movable rod is movable between an engaging position where the positioning end contacts a wall defining one of the first and second shoulder portions, and a disengaging position where the positioning end is disengaged from the one of the first and second shoulder portions.

6 Claims, 13 Drawing Sheets

(56) References Cited

U.S. PATENT DOCUMENTS

| | | | | |
|---|---|---|---|---|
| 2008/0185415 | A1* | 8/2008 | Huang | B25C 1/04 227/8 |
| 2009/0108046 | A1* | 4/2009 | Huang | B25C 1/008 227/8 |
| 2009/0159633 | A1* | 6/2009 | Wu | B25C 1/008 227/8 |
| 2010/0012700 | A1* | 1/2010 | Perron | B25C 1/008 227/8 |
| 2011/0248061 | A1* | 10/2011 | Liu | B25C 1/008 227/8 |
| 2012/0085806 | A1* | 4/2012 | Lee | B25C 1/008 227/8 |
| 2012/0104070 | A1* | 5/2012 | Wu | B25C 1/06 227/8 |
| 2013/0186927 | A1* | 7/2013 | Cheung | B25C 1/08 227/8 |

* cited by examiner

SWITCHING DEVICE FOR A NAIL GUN

CROSS-REFERENCE TO RELATED APPLICATION

This application claims priority to Taiwanese Patent Application No. 107200499 filed on Jan. 11, 2018.

FIELD

The disclosure relates to a switching device, more particularly to a switching device for use in a nail gun.

BACKGROUND

A conventional nail gun such as disclosed in Taiwanese Patent No. 537127 or Taiwanese Patent No. 520691 usually includes a housing body, a safety member movably mounted to the housing body, a valve rod mounted to the housing body and controlling airflow in the nail gun for firing a nail, and a switch device mounted to the housing body and close to the valve rod for switching the nail gun between a single shot mode and a continuous shooting mode.

SUMMARY

Therefore, an object of the present disclosure is to provide a switching device having a structure different from those disclosed in the conventional nail gun to switch the nail gun between a single shot mode and a continuous shooting mode.

According to one aspect of the present disclosure, a switching device adapted for use in a nail gun and operable to switch the nail gun between the single shot mode and the continuous shooting mode is provided. The nail gun includes a housing and a valve rod. The valve rod is mounted to the housing and is operable to control airflow in the nail gun for firing a nail. The switching device includes a trigger unit, a movable rod, a resilient member, and an actuating member.

The trigger unit includes a pair of side walls spaced-apart from each other along an axis, and an interconnecting wall interconnecting the side walls and cooperating with the side walls to define a groove opening toward the valve rod. Each of the side walls includes two opposite side surfaces that are spaced-apart from each other in an axial direction parallel to the axis, a pivoted end portion that is adapted to be pivoted to the housing of the nail gun and a movable end portion that is opposite to the pivoted end portion, that is adapted to be pivotable relative to the nail gun, and that is formed with a slide slot extending through the side surfaces.

For each of the side walls, the slide slot has a first end portion corresponding in position to the movable portion, and a second end portion opposite to the first end portion and corresponding in position to the pivoted end portion. For each of the side walls, the first end portion of the slide slot has a first small diameter portion, a first large diameter portion having a diameter larger than that of the first small diameter portion, and a first shoulder portion formed between the first small diameter portion and the first large diameter portion such that, the first small diameter portion, the first shoulder portion and the first large diameter portion are arranged in the axial direction.

For each of the side walls, the second end portion of the slide slot has a second small diameter portion, a second large diameter portion having a diameter larger than that of the second small diameter portion, and a second shoulder portion formed between the second small diameter portion and the second large diameter portion such that, the second small diameter portion, the second shoulder portion and the second large diameter portion are arranged in the axial direction;

The movable rod extends through the slide slot of each of the side surfaces in the axial direction and has at least one operating end, at least one positioning end and at least one sliding portion disposed between the operating end and the positioning end. The positioning end has an outer diameter in a direction transverse to the axial direction larger than that of the sliding portion such that, when the movable rod is in a selected one of the first and second end portions of the slide slot, the movable rod is movable in the axial direction between an engaging position and a disengaging position. When the movable rod is in the engaging position, the positioning end contacts a wall defining selected one of the first shoulder portion and the second shoulder portion so as to retain the movable rod at the selected one of the first and second end portions of the slide slot. When the movable rod is in the disengaging position, the positioning end is disengaged from the selected one of the first shoulder portion and the second shoulder portion so as to allow the movable rod to be moved from the selected one of the first end portion and the second end portion to the other one of the first end portion and the second end portion of the slide slot.

The resilient member is mounted to the movable rod for biasing the movable rod to move to the engaging position. The actuating member is disposed in the groove, is pivotally connected to the movable rod, and is adapted to be operated to push the valve rod for firing a nail.

BRIEF DESCRIPTION OF THE DRAWINGS

Other features and advantages of the present disclosure will become apparent in the following detailed description of an embodiment with reference to the accompanying drawings, of which.

DETAILED DESCRIPTION

Figure 1:
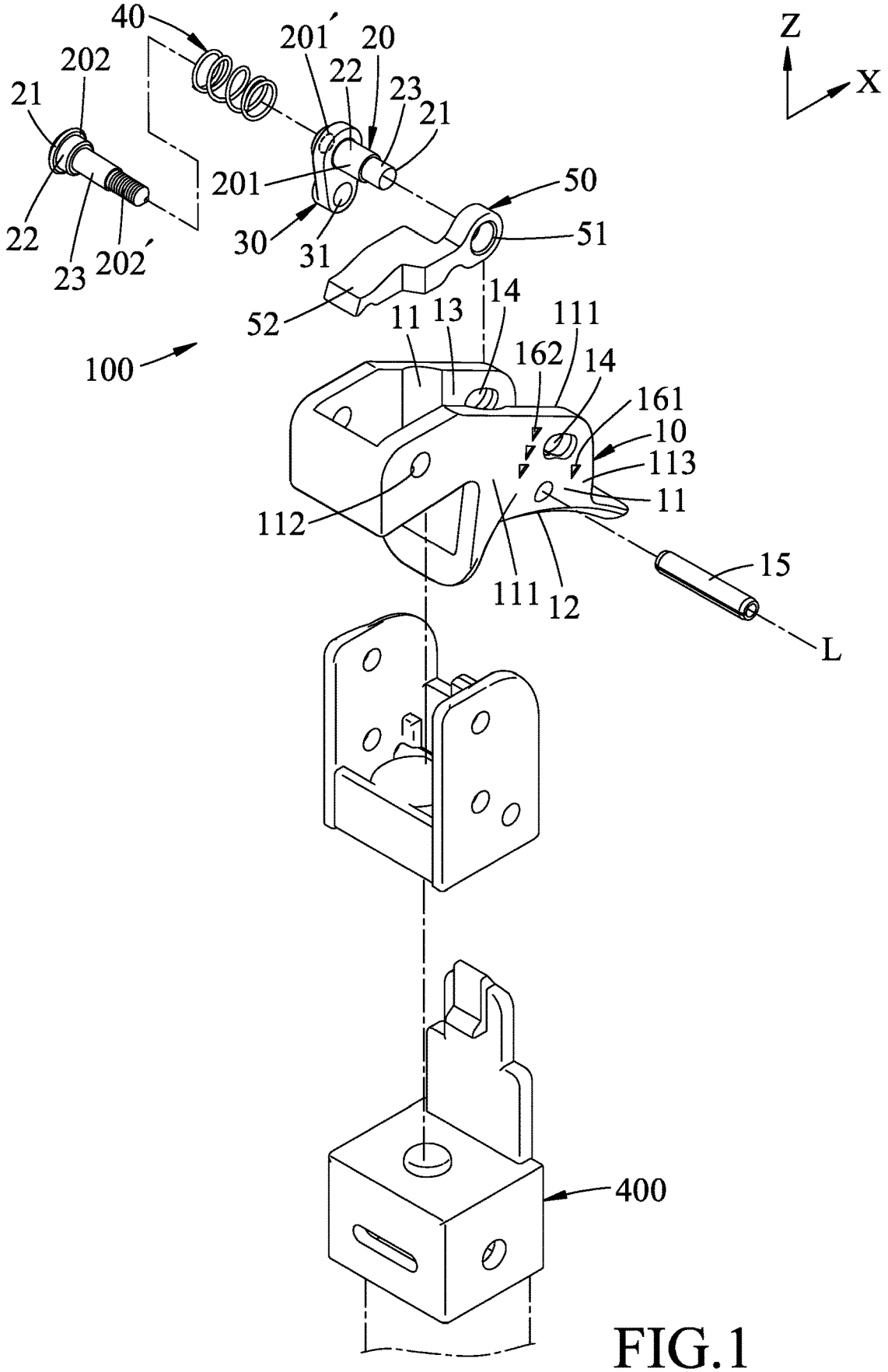
FIG. 1 is an exploded perspective view of a switching device for use in a nail gun according to one embodiment of the present disclosure.

Referring to FIG. 1, a switching device 100 for use in a nail gun according to one embodiment of the present disclosure is shown. Further referring to FIGS. 7-11, the switching device 100 is mounted to the nail gun and is operable to switch the nail gun between a single shot mode and a continuous shooting mode. The nail gun includes a housing 200, a valve rod 300, and a safety rod 400. The valve rod 300 is mounted to the housing 200 and is operable to control airflow in the nail gun for firing a nail. Note that the feature of this disclosure does not reside in the structures of the housing 200 and the safety rod 400 of the nail gun, which is commonly known techniques disclosed in, e.g., Taiwanese Patent No. 537127 or Taiwanese Patent No. 520691, and the present disclosure is not limited in this respect.

The switching device 100 is mounted to the housing 200 at a position adjacent to the valve rod 300 and includes a trigger unit 10, a movable rod 20, a pushing element 30, a resilient member 40, and an actuating member 50.

The trigger unit 10 includes a pair of side walls 11, an interconnecting wall 12 and a pin 15. The side walls 11 are spaced-apart from each other in a first direction (i.e., an axial direction along an axis (L)). The interconnecting wall 12 interconnects the side walls 11 and cooperates with the side walls 11 to define a groove 13 opening toward the valve rod 300. The pin 15 extends through the side walls 11. Each of the side walls 11 has two opposite side surfaces 111 spaced-apart from each other in the first direction, a pivoted end portion 112 that is pivoted to the housing 200 of the nail gun, and a movable end portion 113 that is opposite to the pivoted end portion 112, that is adapted to be pivotable relative to the nail gun, and that is formed with a slide slot 14 extending through the side surfaces 111.

Figure 2:
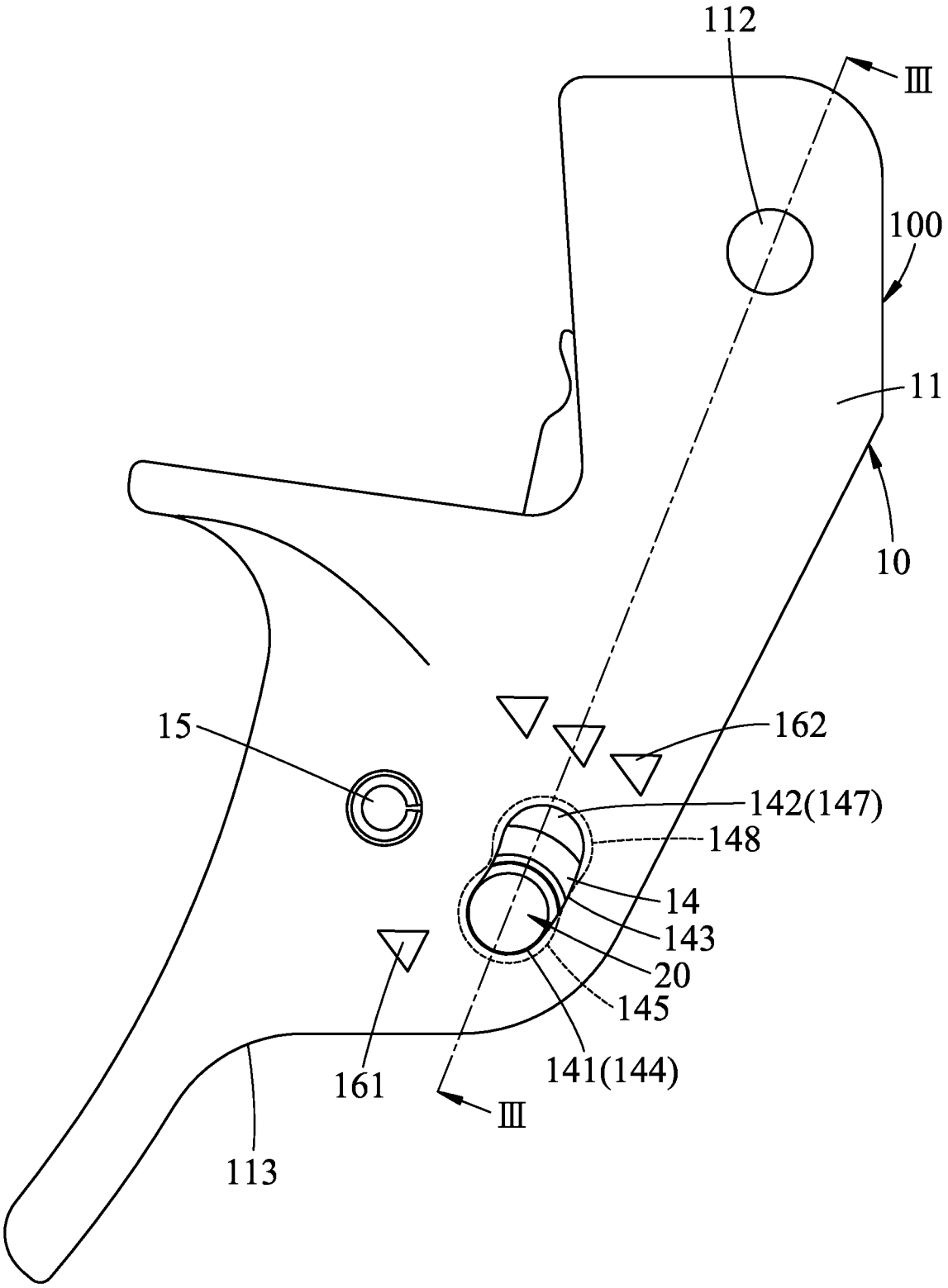
FIG. 2 is a schematic side view of the switching device according to the embodiment of the present disclosure, illustrating a movable rod of the switching device disposed at one end of each slide slot.

In the following description, since the structures of each of the side walls 11 are the same, only one of the side walls 11 will be described for the sake of clarity. Further referring to FIGS. 2 and 3, the slide slot 14 of the side wall 11 has a first end portion 141 corresponding in position to the movable portion 113, a second end portion 142 opposite to the first end portion 141 and corresponding in position to the pivoted end portion 112, and an intermediate portion 143 disposed between the first end portion 141 and the second end portion 142. The first end portion 141 has a first small diameter portion 144, a first large diameter portion 145 having a diameter larger than that of the first small diameter portion 144, and a first shoulder portion 146 formed between the first small diameter portion 144 and the first large diameter portion 145 such that, the first small diameter portion 144, the first shoulder portion 146 and the first large diameter portion 145 are arranged in the first direction. The second end portion 142 has a second small diameter portion 147, a second large diameter portion 148 having a diameter larger than that of the second small diameter portion 147, and a second shoulder portion 149 formed between the second small diameter portion 147 and the second large diameter portion 148 such that, the second small diameter portion 147, the second shoulder portion 149 and the second large diameter portion 148 are arranged in the first direction.

One of the side surfaces 111 of the side wall 11 facing away from the groove 13 in the first direction is formed with a first symbol 161 and a second symbol 162. The first symbol 161 corresponds in position to the first end portion 141 and denotes the single shot mode of the nail gun. The second symbol 162 corresponds in position to the second end portion 142 and denotes the continuous shooting mode of the nail gun. In this embodiment, the first symbol is a triangle and the second symbol is a pattern of three triangles.

Figure 3:
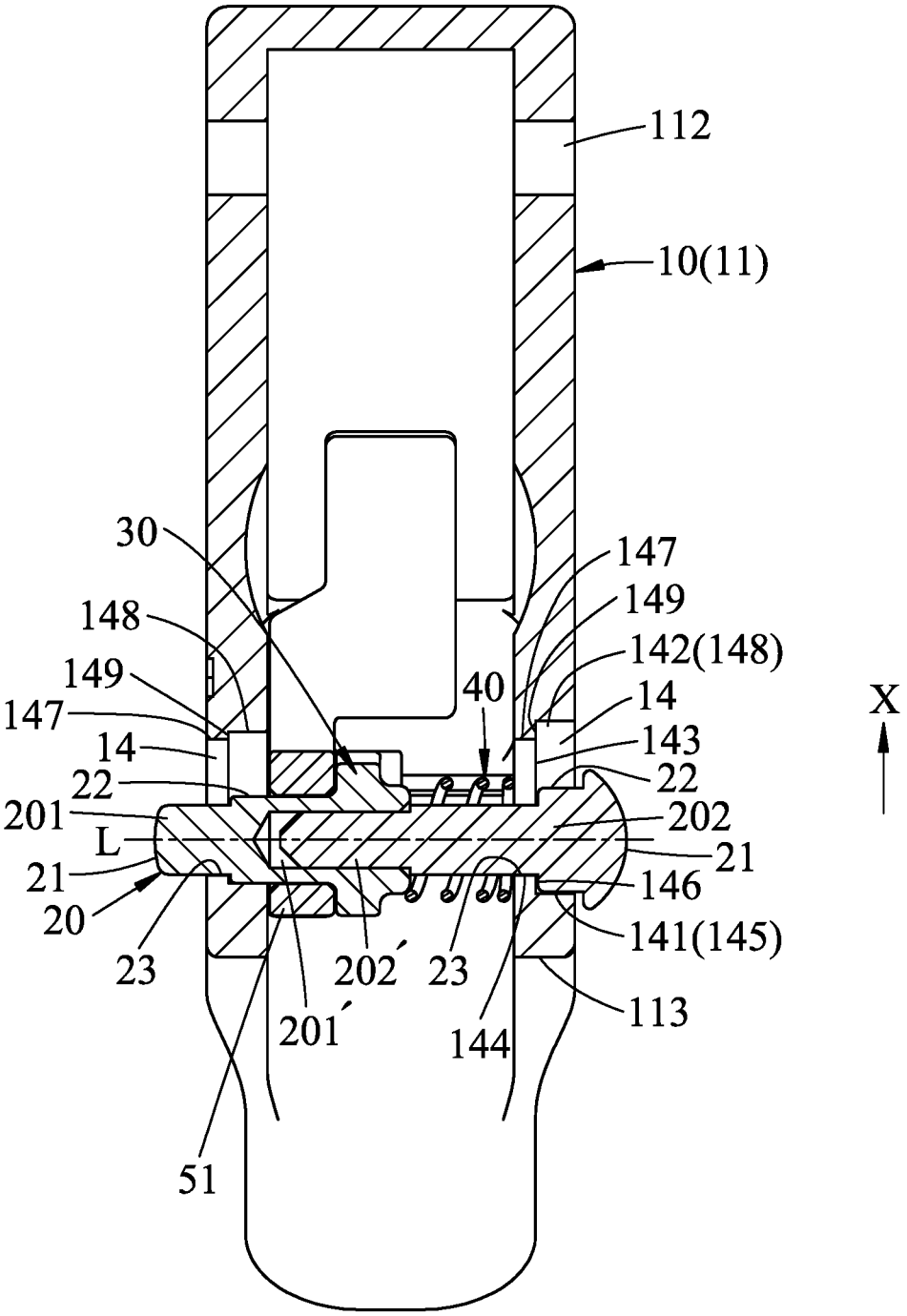
FIG. 3 is a sectional view taken along line III-III in FIG. 2 and illustrating the movable rod in an engaging position.

As shown in FIG. 3, the movable rod 20 extends in the first direction through the slide slots 14 of the side walls 11. In this embodiment, for ease of assembling the movable rod 20 to the side walls 11, the movable rod 20 includes a first rod segment 201 and a second rod segment 202. Each of the first rod segment 201 and the second rod segment 202 has an operating end 21, a positioning end 22 and a sliding portion 23 disposed between the operating end 21 and the positioning end 22. The first rod segment 201 is formed with a hole 201' and the second rod includes a pillar 202' threaded into the hole 201' so as to detachably interconnect the first rod segment 201 to the second rod segment 202 in the first direction.

For each of the first and second rod segments 201, 202, the positioning end 22 thereof has an outer diameter in a second direction (X) transverse to the first direction larger than that of the sliding portion 23. When the movable rod 20 is in a selected one of the first and second end portions 141, 142 of the slide slot 14, the movable rod 20 is movable in the first direction between an engaging position where the positioning end 22 of each of the first and second rod segments 201, 202 contacts a wall defining a corresponding one of the first shoulder portion 146 and the second shoulder portion 149 so as to retain the movable rod 20 at the selected one of the first and second end portions 141, 142 of the slide slot 14, and a disengaging position where the positioning end 22 of each of the first and second rod segments 201, 202 is disengaged from the corresponding one of the first shoulder portion 146 and the second shoulder portion 149, so as to allow the movable rod 20 to be moved from the selected one of the first end portion 141 and the second end portion 142 to the other one of the first end portion 141 and the second end portion 142 in the second direction (X).

The pushing element 30 of the switching device 100 is fixedly connected to the first rod segment 201 of the movable rod 20 and is formed with a through hole 31 through which the pin 15 of the trigger unit 10 extends. In this way, when the movable rod 20 moves in the first direction, the pushing element 30 is moved together with the movable rod 20 and is slidable along the pin 15.

The resilient member 40 is sleeved on the movable rod 20, is disposed in the groove 13, and is for biasing the movable rod 20 to move to the engaging position. In this embodiment, the resilient member 40 is sleeved on the second rod segment 202, and is a compression spring having opposite ends respectively abutting against the pushing element 30 and one of the side surfaces 111 of one of the side walls 11 facing the groove 13 to bias the movable rod 20 to the engaging position.

The actuating member 50 is disposed in the groove 13, is pivotally connected to the movable rod 20, and is operable to push the valve rod 300 to permit airflow entering the nail gun for firing a nail. In this embodiment, the actuating member 50 includes a pivot end 51 and an actuating end 52 opposite to the pivot end 51 in the second direction (X). The pivot end 51 in this embodiment is formed with a through hole through which the first rod segment 201 extends so as to be pivotally connected to the movable rod 20. The actuating member 50 is positioned relative to the trigger unit 10, the safety rod 400 and the valve rod 300 such that when the movable rod 20 is at the engaging position where the positioning end 22 of each of the first and second rod segments 201, 202 contacts a wall defining the first shoulder portion 146 of the corresponding first end portion 141, the nail gun is operable in the single shot mode and that when the movable rod 20 is at the engaging position where the positioning end 22 of each of the first and second rod segments 201, 202 a wall defining the second shoulder portion 149 of the second end portion 142, the nail gun is operable in the continuous shooting mode.

Figure 7C:
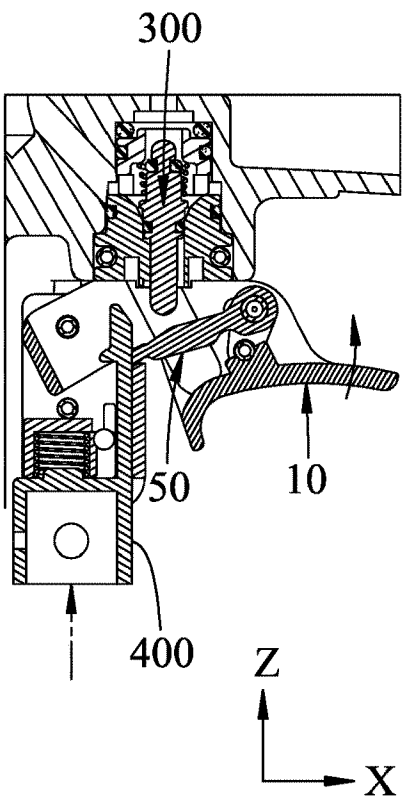
FIGS. 7(*a*) to 7(*c*) are schematic sectional views of the switching device mounted to a nail gun, illustrating a safety operating procedure for prohibiting firing of a nail.
Figure 7B:
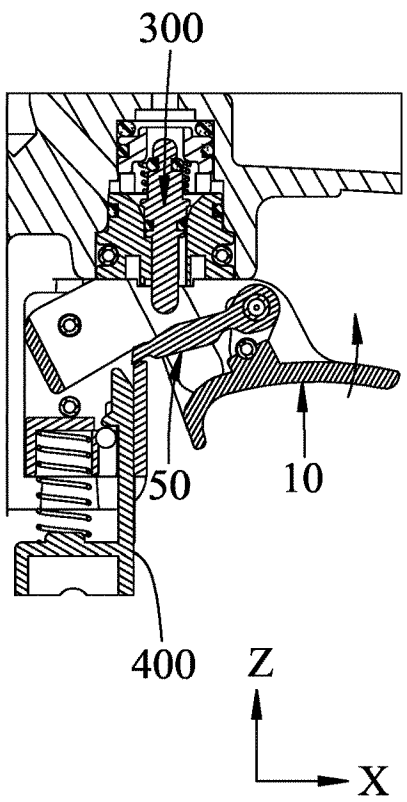
Figure 7A:
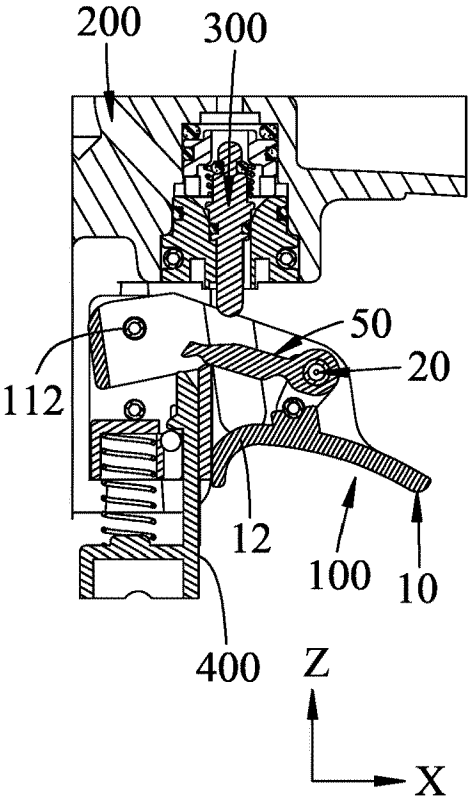

After the switching device 100 is mounted to the housing 200 of the nail gun, as shown in FIG. 7(*a*) to (*c*), a safety operating procedure for prohibiting firing of a nail is to be described. The safety rod 400 is movable between an original position (see FIG. 7(*a*)) and a pushed position (see FIG. 7(*c*)) in a third direction (Z) transverse to the first direction and the second direction (X). As shown in FIG. 7(*a*), when the safety rod 400 is at the original position, when the trigger unit 10 is not pulled, and when the movable rod 20 is at the engaging position where the positioning end 22 of each of the first and second rod segments 201, 202 is in the first large diameter portion 145 and contacts the wall defining the first shoulder portion 146 of the first end portion 141 of the slide slot 14, the valve rod 300 cannot be pushed by the actuating member 50. As shown in FIG. 7(*b*), when the trigger unit 10 is pulled in a direction denoted by a curved arrow with solid line, the valve rod 300 also cannot be pushed by the actuating member 50. Subsequent to the operation in FIG. 7(*b*), as shown in FIG. 7(*c*), without releasing the trigger unit 10, when the safety rod 400 is pushed in the third direction (Z) to the pushed position, the valve rod 300 also cannot be pushed by the actuating member 50 and thus airflow does not enter the nail gun to fire a nail.

Figure 8C:
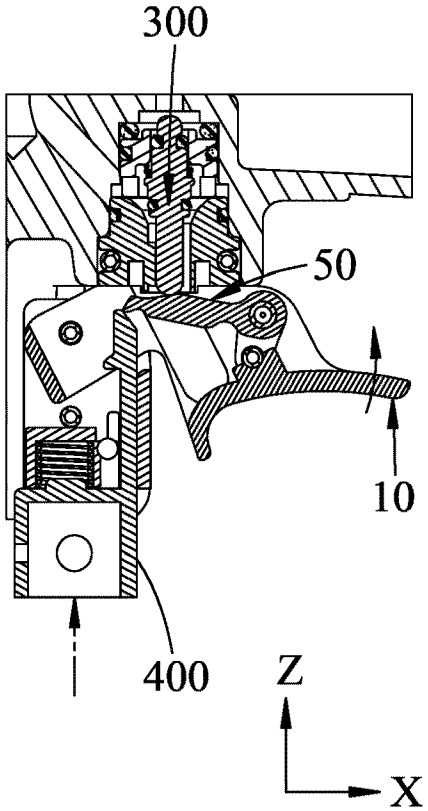
FIGS. 8(*a*) to 8(*c*) are schematic sectional views similar to FIGS. 7(*a*) to 7(*c*) and illustrating an operating procedure in a single shot mode for firing a nail.
Figure 8B:
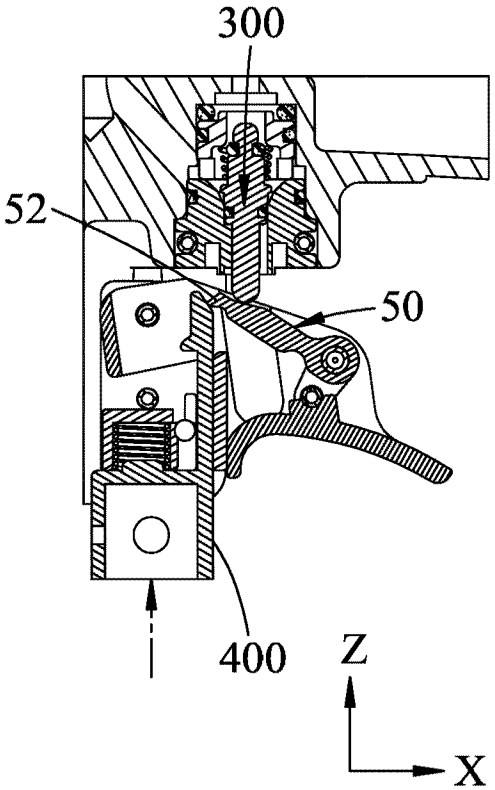
Figure 8A:
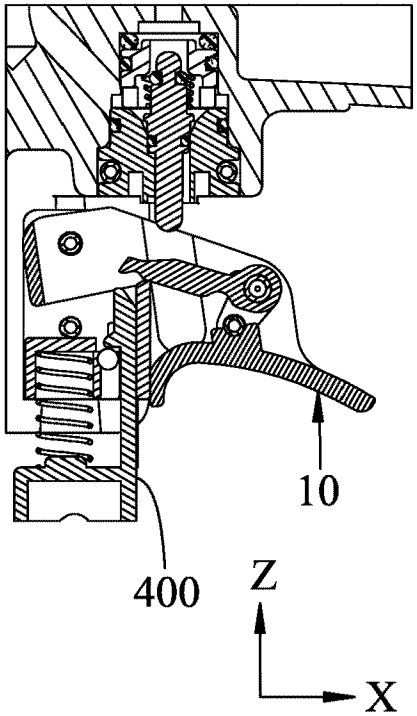

Now referring to FIG. 8(*a*) to (*c*), similar to FIG. 7(*a*) to (*c*), the movable rod 20 is also disposed at the engaging position and the nail gun operates in a single shot mode for firing a nail. FIG. 8(*a*) shows an original position in which neither the safety rod 400 nor the trigger unit 10 is operated. FIG. 8(*b*) shows that the safety rod 400 is first pushed to the pushed position as denoted by an arrow with phantom line, and thus the actuating end 52 of the actuating member 50 is pushed thereby toward the valve rod 300 to a position that has not yet contacted the valve rod 300. Without releasing the safety rod 400, as shown in FIG. 8(*c*), the trigger unit 10 is then pulled and the actuating member 50 pivotally connected to the trigger unit 10 is driven to pivot toward the valve rod 300 so as to contact and push the valve rod 300 to permit airflow entering the nail gun for firing a nail. Then, the safety rod 400 and the trigger unit 10 are both released to return to the original position shown in FIG. 8(*a*). By sequentially repeating the steps shown in FIGS. 8(*a*) to 8(*c*), the nail gun fires one nail at a time. That is to say, the nail gun is permitted to fire a nail only by sequentially pushing the safety rod 400 and pulling the trigger unit 10, and is only permitted to begin subsequent nail firing operations in the single shot mode after the release of both the safety rod 400 and trigger unit 10.

Figure 4:
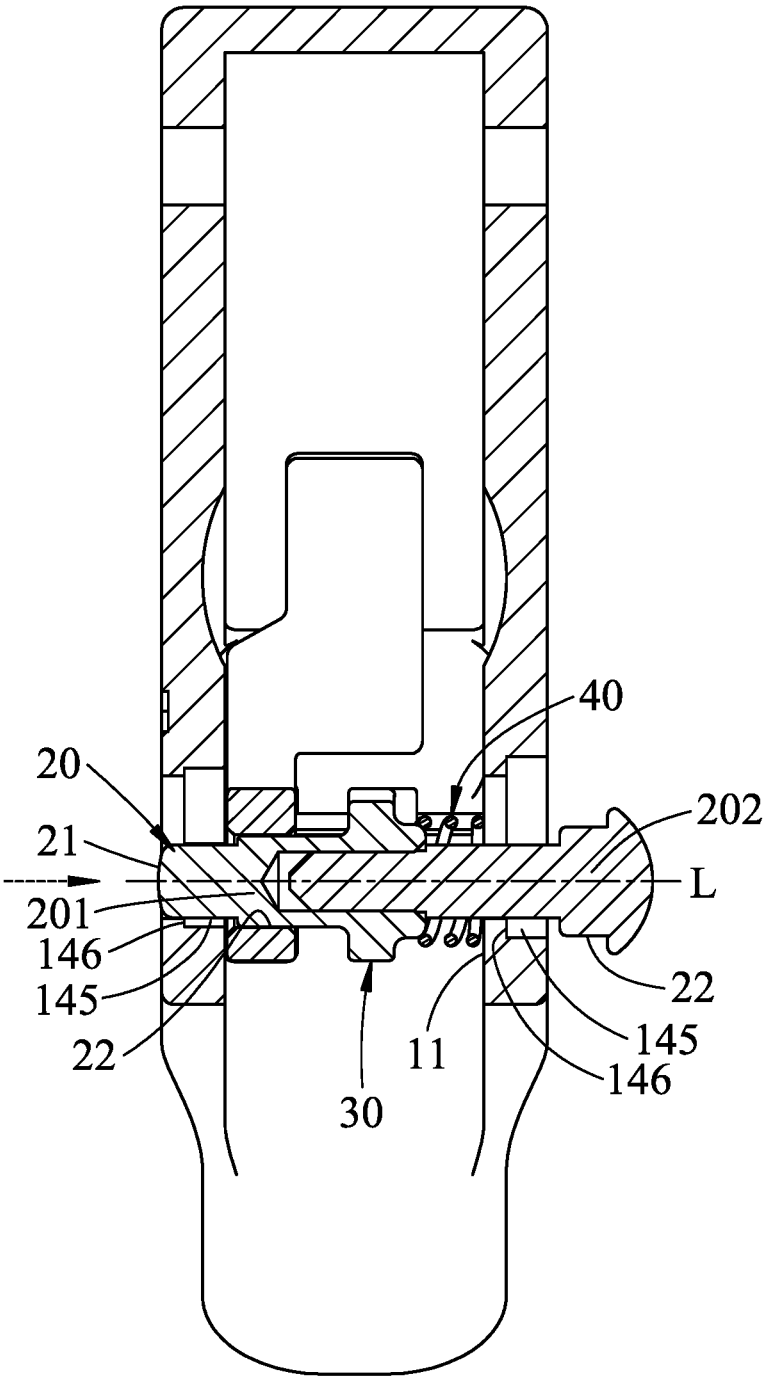
FIG. 4 is a sectional view illustrating the movable rod being moved to a disengaging position where the movable rod is disengaged from said one end of each slide slot.
Figure 5:
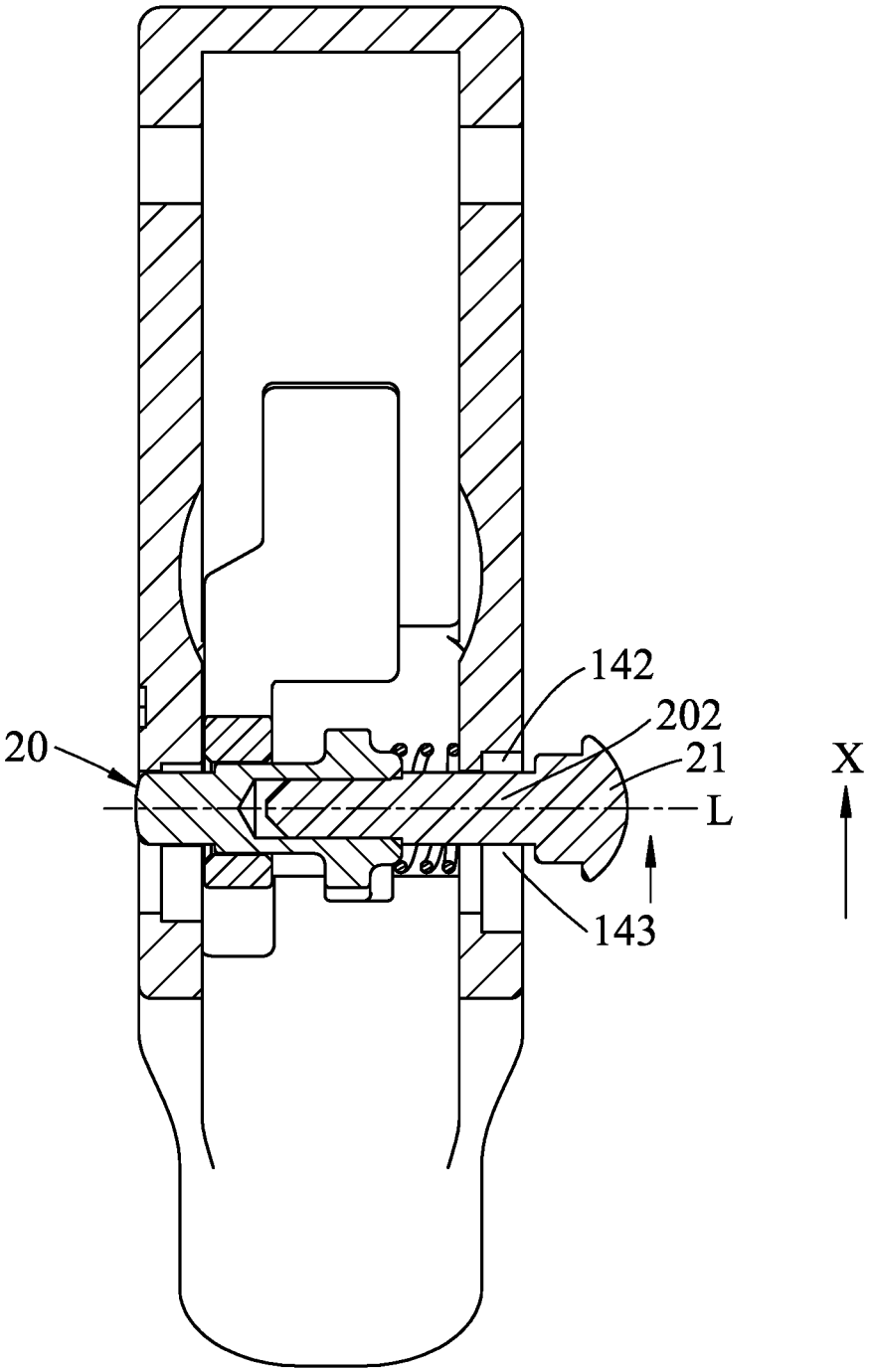
FIG. 5 is a sectional view illustrating the movable rod being moved to the other end of each slide slot.
Figure 9:
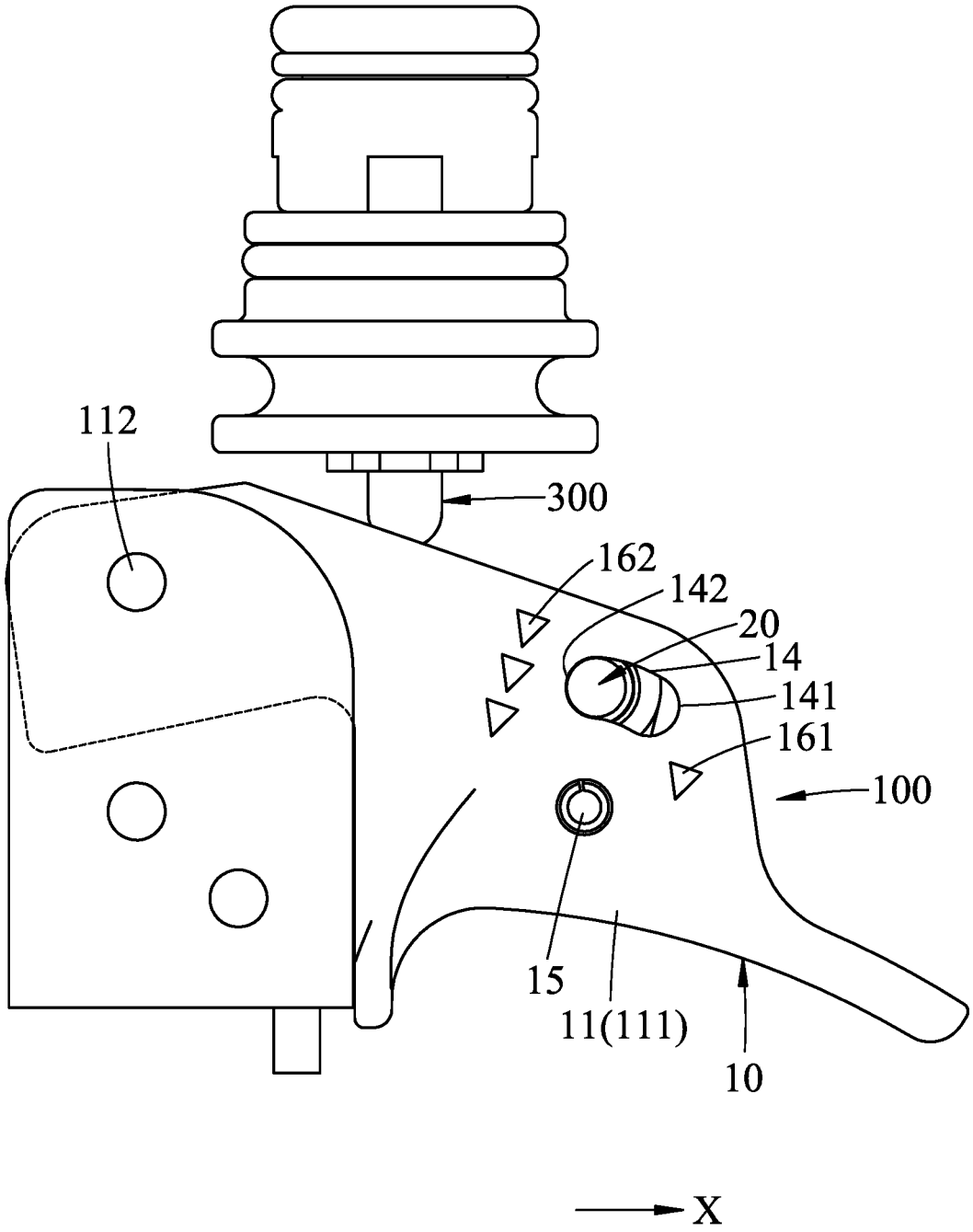
FIG. 9 is a schematic side view of the switching device mounted to the nail gun, illustrating the movable rod disposed in the other end of each slide slot.
Figure 10B:
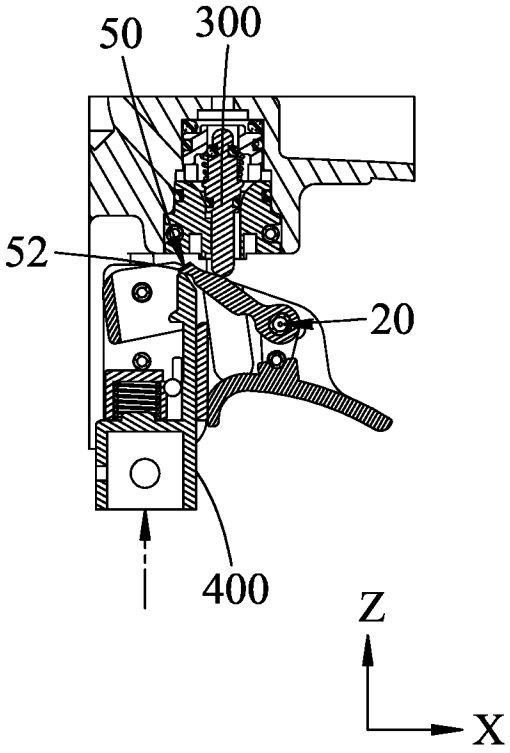
FIGS. 10(*a*) to 10(*d*) are schematic sectional views of the switching device mounted to the nail gun operated in a continuous shooting mode and illustrating an operating procedure for continuously shooting nails.
Figure 10A:
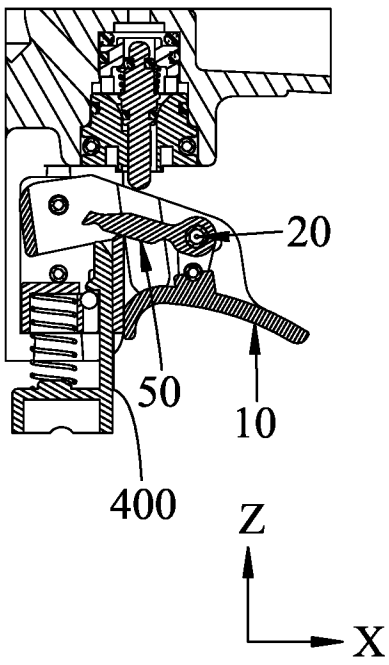
Figure 10D:
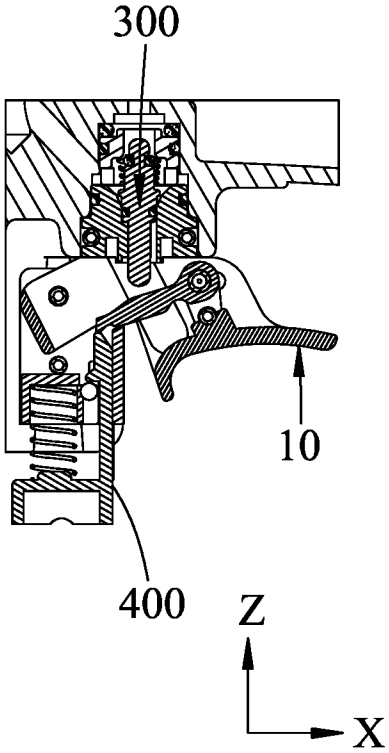
Figure 10C:
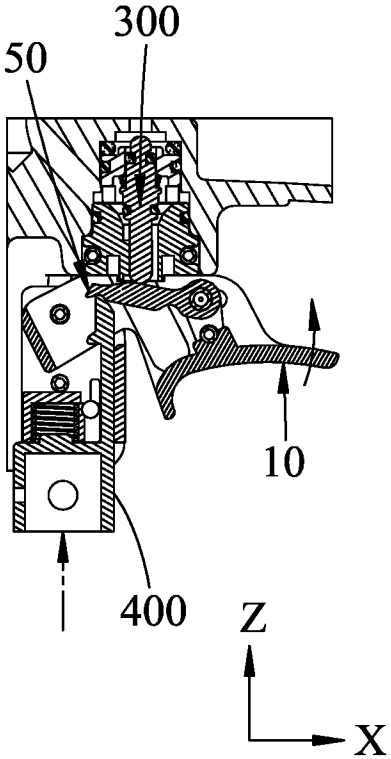
Figure 11B:
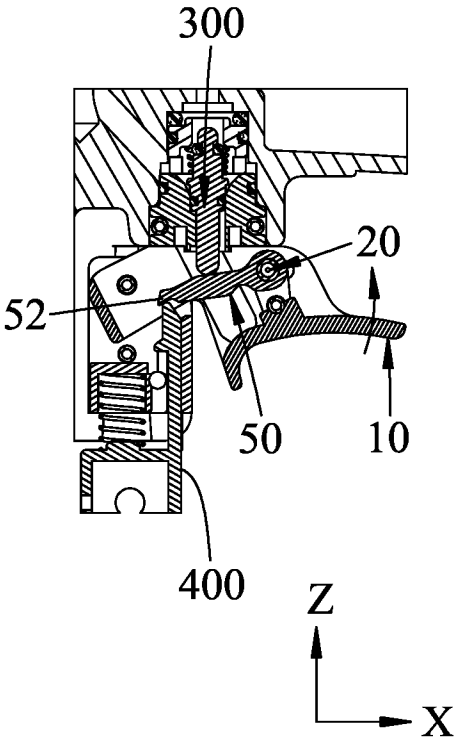
FIGS. 11(*a*) to 11(*d*) are schematic sectional views similar to FIGS. 10(*a*) to 10(*c*) and illustrating another operation procedure for continuously firing nails.
Figure 11A:
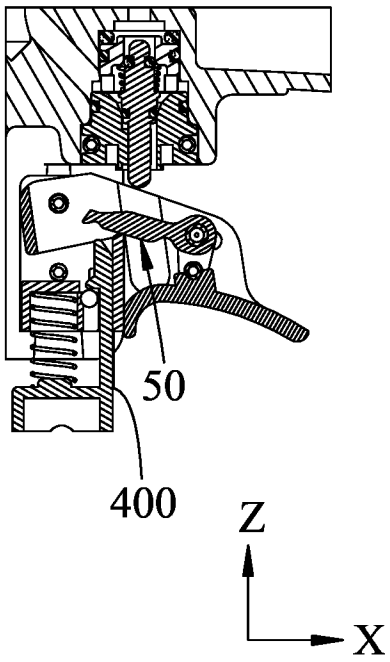
Figure 11D:
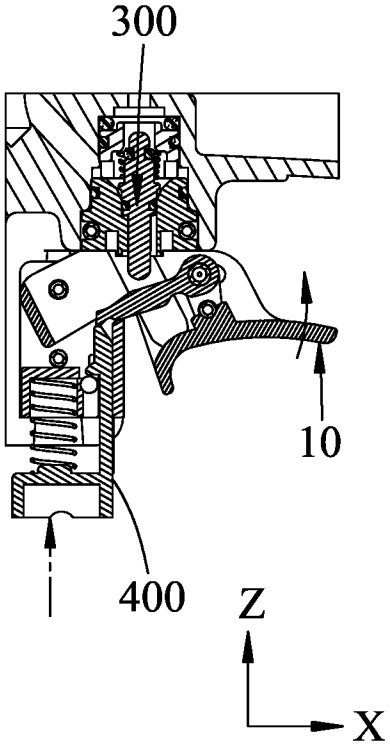
Figure 11C:
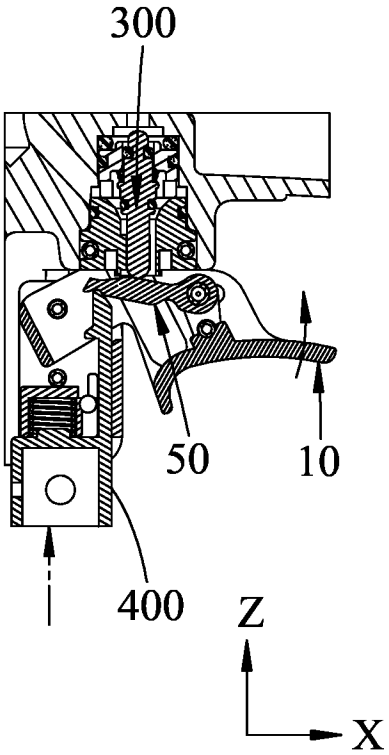

Now referring to FIG. 4, to switch the nail gun from the single shot mode to the continuous shooting mode, the operating ends 21 of the first rod segment 201 is first pushed by a force denoted by an arrow with dash line in the first direction to move the movable rod 20 to the disengaging position, where the positioning end 22 of each of the first and second rod segments 201, 202 is disengaged from the first shoulder portion 146 and the resilient member 40 is compressed between the pushing element 30 and one of the side walls 11 to store a restoring force. Subsequently, further referring to FIG. 5, the operating end 21 of the second rod segment 202 is moved by a force denoted by an arrow with solid line in the second direction (X) to move the movable rod 20 to the second end portion 142 corresponding in position to the second symbol 162 as illustrated in FIG. 9.

Figure 6:
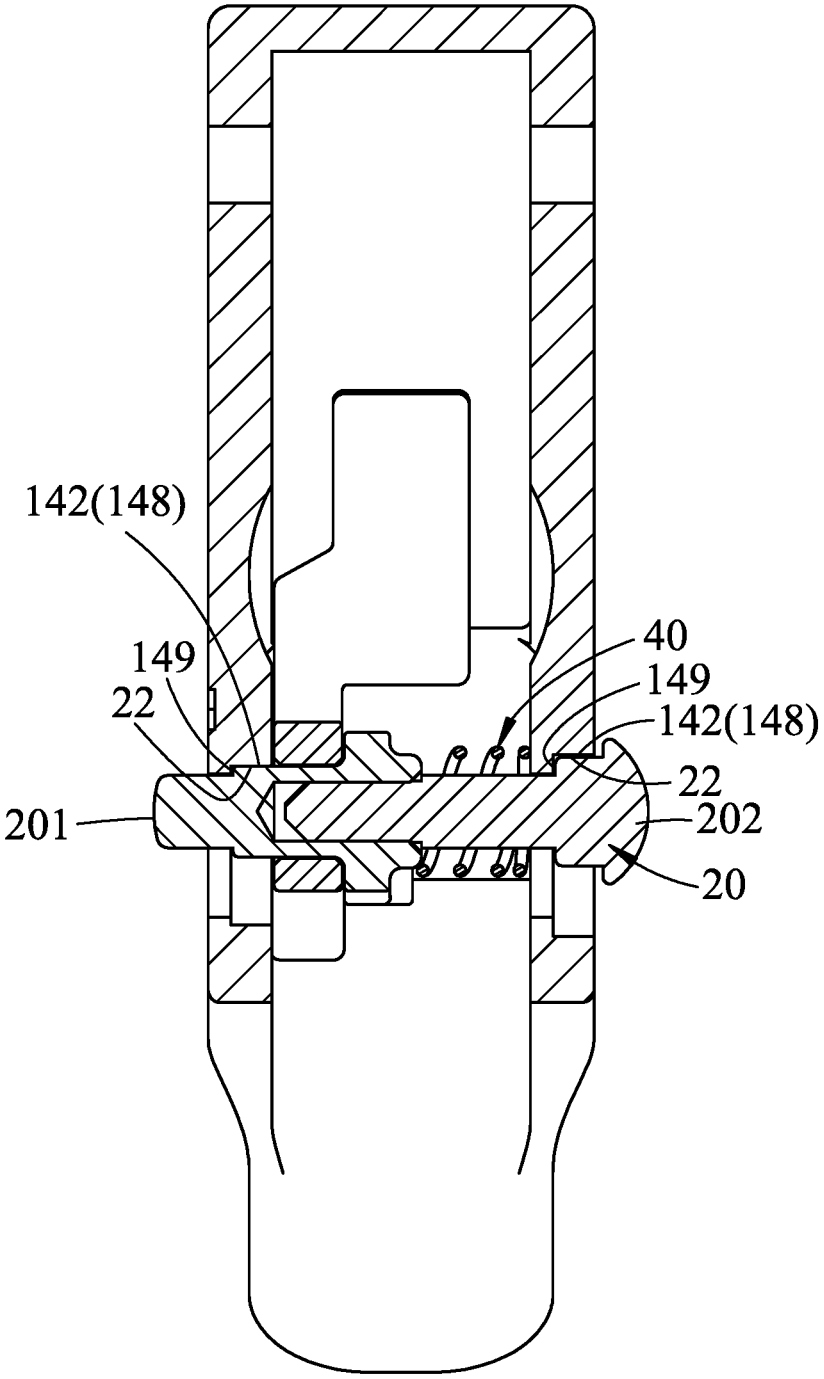
FIG. 6 is a sectional view illustrating the movable rod being moved to the engaging position and positioned in the other one end of each slide slot.

Further referring to FIG. 6, when the force exerted on the movable rod 20 is released, the resilient member 40 biases the movable rod 20 by the restoring force to move to the engaging position where the positioning end 22 of each of the first and second rod segments 201, 202 is in the second large diameter portion 148 and contacts the wall defining the second shoulder portion 149 so as to retain the movable rod 20 at the second end portion 142 of the slide slot 14.

Note that by virtue of the first symbol 161 and the second symbol 162, a user of the nail gun can easily realize that the nail gun is in the single shot mode or the continuous shooting mode from the position of the movable rod 20 being close to which one of the first and second symbols 161, 162. That is, when the movable rod 20 is at the first end portion 141 corresponding in position to the first symbol 161, the nail gun operates in the single shot mode, and when the movable rod 20 is at the second end portion 142 corresponding in position to the second symbol 162, the nail gun operates in the continuous shooting mode, as respectively shown in FIGS. 2 and 9.

FIGS. 10(*a*)-(*d*) and 11(*a*)-(*d*) respectively illustrate different operating procedures of the nail gun operated in the continuous shooting mode. As compared to the FIGS. 7(*a*)-(*c*) and 8(*a*)-(*c*), the actuating member 50 shown in FIGS. 10(*a*)-(*d*) and 11(*a*)-(*d*) is moved together with the movable rod 20 in the second direction (X) toward the safety rod 400 since the movable rod 20 is moved from the first end portion 141 to the second end portion 142 in the second direction (X). Now referring to FIGS. 10(*a*)-10 (*d*), FIG. 10(*a*) also shows an original position in which neither the safety rod 400 nor the trigger unit 10 is operated. FIG. 10(*b*) shows that the safety rod 400 is first pushed in the third direction (Z) as denoted by an arrow with phantom line toward the valve rod 300 to the pushed position, and the actuating end 52 of the actuating member 50 is pushed by the safety rod 400 to pivot to contact the valve rod 300. Then, in FIG. 10(*c*), without releasing the safety rod 400, the trigger unit 10 is pulled as denoted by a curved arrow with solid line and thus the actuating member 50 pushes the valve rod 300 to permit airflow entering the nail gun to fire a nail. As shown in FIG. 10(*d*), without releasing the trigger unit 10, each movement of the safety rod 400 from the original position shown in FIG. 10(*a*) to the pushed position shown in FIG. 10(*b*) results in firing of one nail.

As shown in FIGS. 11(*a*)-(*d*), another operating procedure for operating the nail gun in the continuous shooting mode is now described. FIG. 11(*b*) shows that the trigger unit 10 is first pulled as denoted by a curved arrow with solid line toward the valve rod 300, and the actuating end 52 of the actuating member 50 pivots relative to the movable rod 20 to contact the safety rod 400 at a position different from that shown in FIG. 7(*b*). Then, in FIG. 11(*c*), without releasing the trigger unit 10, the safety rod 400 is pushed as denoted by an arrow with phantom line and thus the actuating member 50 pushes the valve rod 300 to permit airflow entering the nail gun to fire a nail. As shown in FIG. 11(*d*), without releasing the trigger unit 10, each movement of the safety rod 400 from the original position shown in FIG. 11(*b*) to the pushed position shown in FIG. 10(*c*) results in firing of one nail.

In this way, no matter which one of the safety rod 400 and the trigger unit 10 is operated first and without releasing the same, the other one of the safety rod 400 and the trigger unit 10 can be operated to enable the nail gun to continuously fire nails by reciprocating the safety rod 400.

To sum up, the structure of the switching device 100 of this disclosure is simple and is easy to assemble and operate. By virtue of the cooperation among the slide slots 14 of the side walls 11 and the movable rod 20, the movable rod 20 can be moved between the first and second end portions 141, 142 of each slide slot 14 easily by pushing one of the operating ends 21 in the first direction and then pushing the other one of the operating ends 21 in the second direction (X) to thereby switch the nail gun between the single shot mode and the continuous shooting mode. Additionally, the user can simply realize that the nail gun is at the single shot mode or the continuous shooting mode from the position of the movable rod 20 being close to which one of the first and second symbols 161, 162.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A switching device adapted for use in a nail gun and operable to switch the nail gun between a single shot mode and a continuous shooting mode, the nail gun including a housing, a valve rod that is mounted to the housing and that is operable to control airflow in the nail gun for firing a nail, said switching device comprising:

a trigger unit including a pair of side walls spaced-apart from each other along an axis, and an interconnecting wall interconnecting said side walls and cooperating with said side walls to define a groove opening toward the valve rod, each of said side walls having two opposite side surfaces that are spaced-apart from each other in an axial direction parallel to said axis, a pivoted end portion that is adapted to be pivoted to the housing of the nail gun and a movable end portion that is opposite to said pivoted end portion, that is adapted to be pivotable relative to the nail gun, and that is formed with a slide slot extending through said side surfaces, for each of said side walls, said slide slot having a first end portion corresponding in position to said movable portion and a second end portion opposite to said first end portion and corresponding in position to said pivoted end portion, said first end portion of said slide slot having a first small diameter portion, a first large diameter portion having a diameter larger than that of said first small diameter portion, and a first shoulder portion formed between said first small diameter portion and said first large diameter portion such that, said first small diameter portion, said first shoulder portion and said first large diameter portion are arranged in the axial direction, said second end portion of said slide slot having a second small diameter portion, a second large diameter portion having a diameter larger than that of said second small diameter portion and a second shoulder portion formed between said second small diameter portion and said second large diameter portion such that, said second small diameter portion, said second shoulder portion and said second large diameter portion are arranged in the axial direction;

a movable rod extending through said slide slot of each of said side surfaces in the axial direction and having at least one operating end, at least one positioning end and at least one sliding portion disposed between said operating end and said positioning end, said positioning end having an outer diameter in a direction transverse to the axial direction larger than that of said sliding portion such that, when said movable rod is in a selected one of said first and second end portions of said slide slot, said movable rod is movable in the axial direction between an engaging position where said positioning end contacts a wall defining one of said first shoulder portion and said second shoulder portion so as to retain said movable rod at the selected one of said first and second end portions of said slide slot, and a disengaging position where said positioning end is disengaged from said selected one of said first shoulder portion and said second shoulder portion so as to allow said movable rod to be moved from the selected one of said first end portion and said second end portion to the other one of said first end portion and said second end portion of said slide slot;

a resilient member mounted to said movable rod for biasing said movable rod to move to the engaging position; and an actuating member disposed in said groove, pivotally connected to said movable rod, and adapted to be operated to push the valve rod for firing a nail.

2. The switching device as claimed in claim 1, further comprising a pushing element fixedly connected to said movable rod, said trigger unit further including a pin extending through said side walls and said pushing element, said pushing element being slidable along said pin, said resilient member being sleeved on said movable rod and having opposite ends respectively abutting against said pushing element and one of said side walls.

3. The switching device as claimed in claim 1, wherein said movable rod includes a first rod segment and a second rod segment detachably connected to said first rod segments in the axial direction, each of said first rod segment and said second rod segment having said operating end, said sliding portion and said positioning end.

4. The switching device as claimed in claim 3, wherein said first rod segment is formed with a hole and said second rod segment including a pillar threaded into said hole so as to connect said first rod segment to said second rod segment.

5. The switching device as claimed in claim 1, the nail gun further including a safety rod, wherein said actuating member is adapted to be positioned relative to said trigger unit, said safety rod and said valve rod such that, when said movable rod is at the engaging position where said positioning end contacts a wall defining said first shoulder portion of said first end portion, the nail gun is operable in the single shot mode, and when said movable rod is at the engaging position where said positioning end contacts a wall defining said second shoulder portion of said second end portion, the nail gun is operable in the continuous shooting mode.

6. The switching device as claimed in claim 1, wherein at least one of said side walls of said trigger unit is formed with a first symbol corresponding in position to said first end portion of a corresponding one of said side walls and denoting the single shot mode and a second symbol corresponding in position to said second end portion of the corresponding one of said side walls and denoting the continuous shooting mode.

* * * * *